US005746041A

United States Patent [19]

Tolson

[11] Patent Number: 5,746,041

[45] Date of Patent: May 5, 1998

[54] SHRINKING SELECTED PORTIONS OF FILM WRAPPED AROUND A PRODUCT

[75] Inventor: Sidney S. Tolson, Scotland Neck, N.C.

[73] Assignee: Ossid Corporation, Rocky Mount, N.C.

[21] Appl. No.: 718,069

[22] Filed: Sep. 17, 1996

[51] Int. Cl.[6] ..... B65B 53/02

[52] U.S. Cl. ..... 53/442; 53/557

[58] Field of Search ..... 53/442, 557

[56] References Cited

U.S. PATENT DOCUMENTS

| | | | |
|---|---|---|---|
| 4,228,345 | 10/1980 | Stricker et al. | 53/557 X |
| 5,062,217 | 11/1991 | Tolson | 34/216 |
| 5,193,290 | 3/1993 | Tolson | 53/442 X |
| 5,398,427 | 3/1995 | Tolson | 34/216 |
| 5,546,677 | 8/1996 | Tolson | 53/442 X |
| 5,590,509 | 1/1997 | Esteves et al. | 53/442 X |

FOREIGN PATENT DOCUMENTS

| | | | |
|---|---|---|---|
| 134689 | 3/1985 | European Pat. Off. | 53/442 |
| 2737106 | 2/1979 | Germany | 53/557 |
| 666341 | 7/1988 | Switzerland | 53/557 |
| 9011223 | 10/1990 | WIPO | 53/557 |

*Primary Examiner*—Linda Johnson
*Attorney, Agent, or Firm*—Olive & Olive, P.A.

[57] ABSTRACT

The invention provides an endless conveyor having a pair of gaps in its product conveying surface. As a film-wrapped product is conveyed across the gaps, a sensor aligned with the second gap signals the initiation of a shrinking sequence by which a pair of upwardly directed nozzles impinge hot air on the portion of film below and inboard of the transverse film seals. As the flow of hot air begins, a pair of magnetic clutches are activated to transmit power from a drive to a pair of shafts on which each clutch is respectively mounted. The drive, through the clutches, causes each of the nozzles to rotate about an axis so that the stream of hot air follows the travel of the wrapped product to maximize the time of hot air exposure without slowing the speed of product travel. At the end of the arc through which the nozzle is pivoted, the hot air flow is shut off, the magnetic clutches are deactivated, and a biasing spring causes the nozzles to return to their respective starting positions. Subsequently, the package is conveyed through a shrink tunnel providing ambient hot air to shrink the balance of the film wrap.

10 Claims, 5 Drawing Sheets

SHRINKING SELECTED PORTIONS OF FILM WRAPPED AROUND A PRODUCT

FIELD OF THE INVENTION

This invention relates to an apparatus and method for the shrinking of heat-shrinkable film wrapped around a product and more particularly to shrinking selected portions of said film.

BACKGROUND OF THE INVENTION

Many products are wrapped in a heat-shrinkable film which is subsequently shrunk by the application of heat. The film is typically preprinted with the producer's name, producer's logo and other information of interest and use to the consumer. Often portions of the film are left transparent and the enclosed product is visible, making the commercial appeal to the prospective purchaser somewhat dependent on the package appearance. Efforts have been made in the past to improve the appearance of the package being displayed for sale by assuring that the film appears with few or no wrinkles and preferably tightly fitted around the enclosed product. It has been recognized that a smooth, wrinkle-free heat-shrunk wrap can often be best achieved by applying heat to selected portions of the film wrap before applying it to other portions.

For reasons of market presentation, a significant portion of the top surface of film used to wrap a packed tray of products, e.g. poultry parts, is frequently printed, with the exception of a clear portion for product visibility. The bottom of the film used to wrap the mentioned packed tray of products is typically also printed with appropriate information. In addition, a top and bottom portion of film must be left without print in the area between sequential packages for forming transverse seals, since printed film will not seal reliably. In the processing known before the present invention, it was not possible to reliably shrink the film wrap such that the printed portion was properly positioned and centered over the top of the tray and the clear, unprinted end portions were tucked below the tray rim after completion of the shrinking process. For example, when improperly shrunk, portions of the film which is unprinted and which should normally reside below the ends of the tray, instead would tend to reside over the tray top, resulting in an unsightly package.

Some examples of known methods for the shrinking of heat-shrinkable film are disclosed in U.S. Pat. No. 5,062,217 for a SELECTIVE SEQUENTIAL SHRINK APPARATUS AND PROCESS; U.S. Pat. No. 5,193,290 for an APPARATUS AND METHOD FOR SEQUENTIAL SHRINKING OF PACKAGING FILM; and U.S. Pat. No. 5,398,427 for an APPARATUS AND METHOD FOR DIFFERENTIALLY SHRINKING SELECTED PORTIONS OF HEAT SHRINKABLE FILM WRAPPED AROUND A PRODUCT, all granted to the present applicant, the teachings of which are incorporated herein by reference.

An improvement over the apparatus and methods of the above noted patents is disclosed in patent application Ser. No. 08/411,898, entitled APPARATUS AND METHOD FOR SHRINKING FILM WRAPPED AROUND A PRODUCT filed by the present inventor on Mar. 28, 1996, scheduled to be issued as U.S. Pat. No. 5,546,677 on Aug. 20, 1996. The teachings of U.S. Pat. No. 5,546,677 are also incorporated herein by reference. The apparatus taught therein rotates an end-sealed film-wrapped package 90° so as to orient its transverse end seams in a direction parallel to the path of a conveyor which then transports the package through a directed hot air shrink station. As the package moves through the shrink station, hot air is first directed to the portions of film below and inboard of the end seams so as to cause initial shrinkage in that segment of film, referred to as the target area, after which as the package continues to move, the balance of the film is shrunk in a heated environment.

In another aspect of the invention, it is to be noted that recent changes in the laws and regulations governing packaging and labelling of meat products require that each package be marked with safe handling and cooking procedures, and that the print be clear and readable. In the interest of compliance and consumer relations, processors of poultry parts, in particular, have been seeking a package print which after being shrunk exceeds the readability requirement and is thus sharp and bold. To achieve that level of packaging print quality, it is both necessary to shrink the preprinted heat-shrinkable film without forming wrinkles and protect the printed portions from heat-induced discoloration or distortion.

In another aspect of the prior art, a widely used method of film wrapping a product results in a longitudinal bottom seam and a transverse seam at the leading and trailing ends of the package. The present invention is directed to this form of packaging. As one embodiment of this form of packaging and in response to the new laws and regulations, applicant's U.S. Pat. No. 5,421,139, entitled METHOD OF MAKING A FILM WRAPPED PRODUCT HAVING AN OFF-CENTER SEAM, teaches a method for laterally off-setting the bottom longitudinal seam to better facilitate the placement of printed information regarding storage and cooking.

With the foregoing in mind, the present invention has as one object that of providing an apparatus and method for accomplishing the described preferred shrink of the film in a target area inboard of and below the end seams without the need for rotating the wrapped package.

It is an additional object of the invention to provide an apparatus and method for the shrinking of heat-shrinkable film wrapped around a product which results in a wrinkle-free finished package appearance.

A further object of the invention is to provide an apparatus and method for the shrinking of preprinted heat-shrinkable film wrapped around a product in a manner which minimizes the discoloration and distortion of print on the film.

Other objects and advantages will be more fully apparent from the following disclosure and appended claims.

SUMMARY OF THE INVENTION

The invention provides an apparatus and method for shrinking of film wrapped around a product in a portion below and inboard of each of its transverse end seams. A heat source directed at this film portion is caused to travel in a direction and at a speed equal to that of the package to optimize this film shrink prior to applying heat for shrinking the balance of the film wrap.

DETAILED DESCRIPTION OF THE INVENTION AND PREFERRED EMBODIMENTS THEREOF

Figure 1:
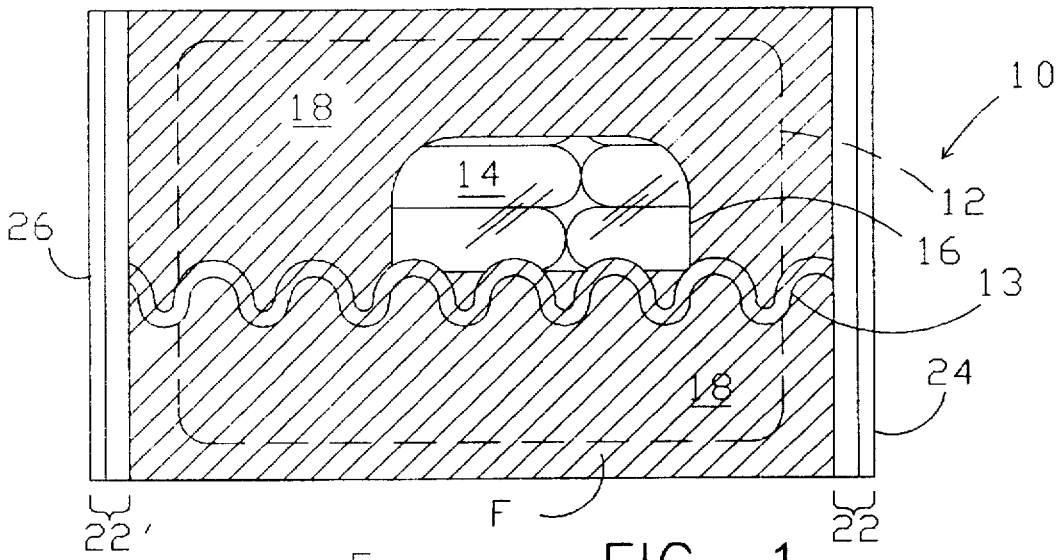
FIG. 1 is a top plan view of a film-wrapped tray carrying a product before the film is caused to shrink, with printed portions of the film illustrated as being shaded.

A film-wrapped package 10 with its ends sealed is schematically illustrated in FIG. 1 with a heat shrinkable film F wrapped somewhat loosely around tray 12 which contains product 14 which may, for example, be poultry parts. Shaded portions 18 of film F indicate areas which are printed with opaque ink. Window 16 remains clear and is located in the vicinity of the center of tray 12 to enable the consumer to view product 14. The serpentine line 13 across the center of package 10 serves, by way of illustration, as a printed decorative divider between window 14 and upper and lower printed portions 18. Clear borders 22 and 22' of film F, respectively, are maintained without ink coverage to allow secure sealing of the film at leading seam 24 and trailing seam 26.

Figure 3:
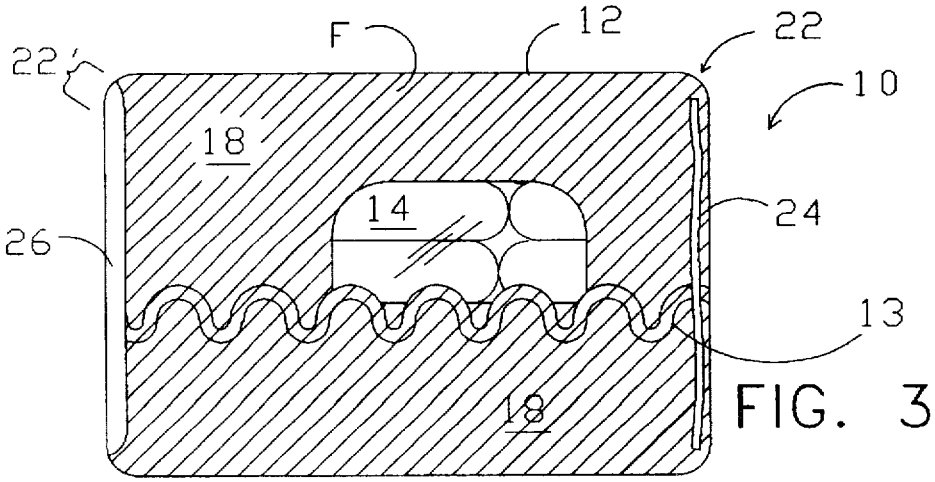
FIG. 3 is a top plan view of the film-wrapped tray of FIG. 1 in which the film has been shrunk improperly.

If heat is applied indiscriminately or incorrectly to film F of package 10, a typical result would be an irregular, wrinkled appearance of film F and the possibility that clear leading and trailing borders 22, 22' would be improperly positioned on the package top surface, as is shown, by way of illustration, in FIG. 3. Beyond displaying an unacceptable appearance, the clear seam portion shown at 24, 26, for example, can show a quantity of fluid if product 14 is not frozen and tray 12 is positioned at an angle to the horizontal for sales presentation. This fluid visibility is not considered desirable in a merchandising sense.

Figure 2:
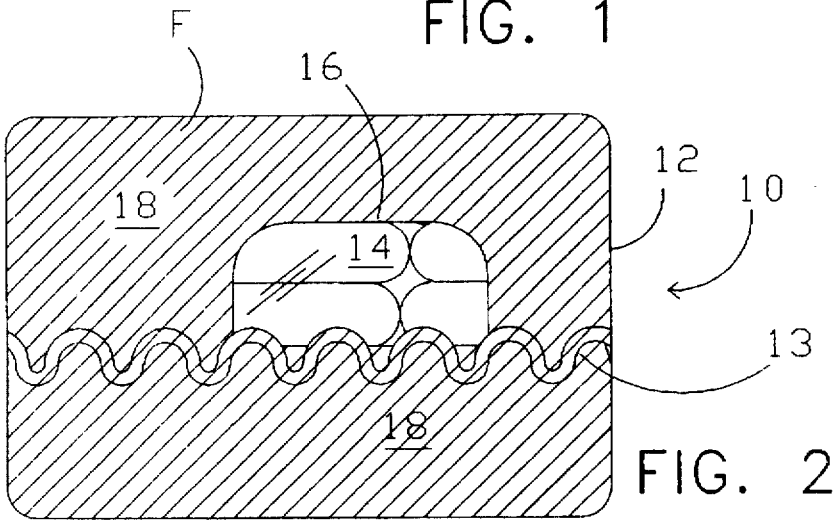
FIG. 2 is a top plan view of the film-wrapped tray of FIG. 1 in which the film has been properly shrunk according to the present invention.

The preferred appearance of package 10 is shown in FIG. 2, where film F conforms tightly to tray 12 and the leading and trailing seams 24, 26 (FIG. 1) are hidden beneath the rim of tray 12. In FIG. 2, window 16 is the only clear portion of film F visible from above, thus illustrating the desired package appearance.

Figure 4:
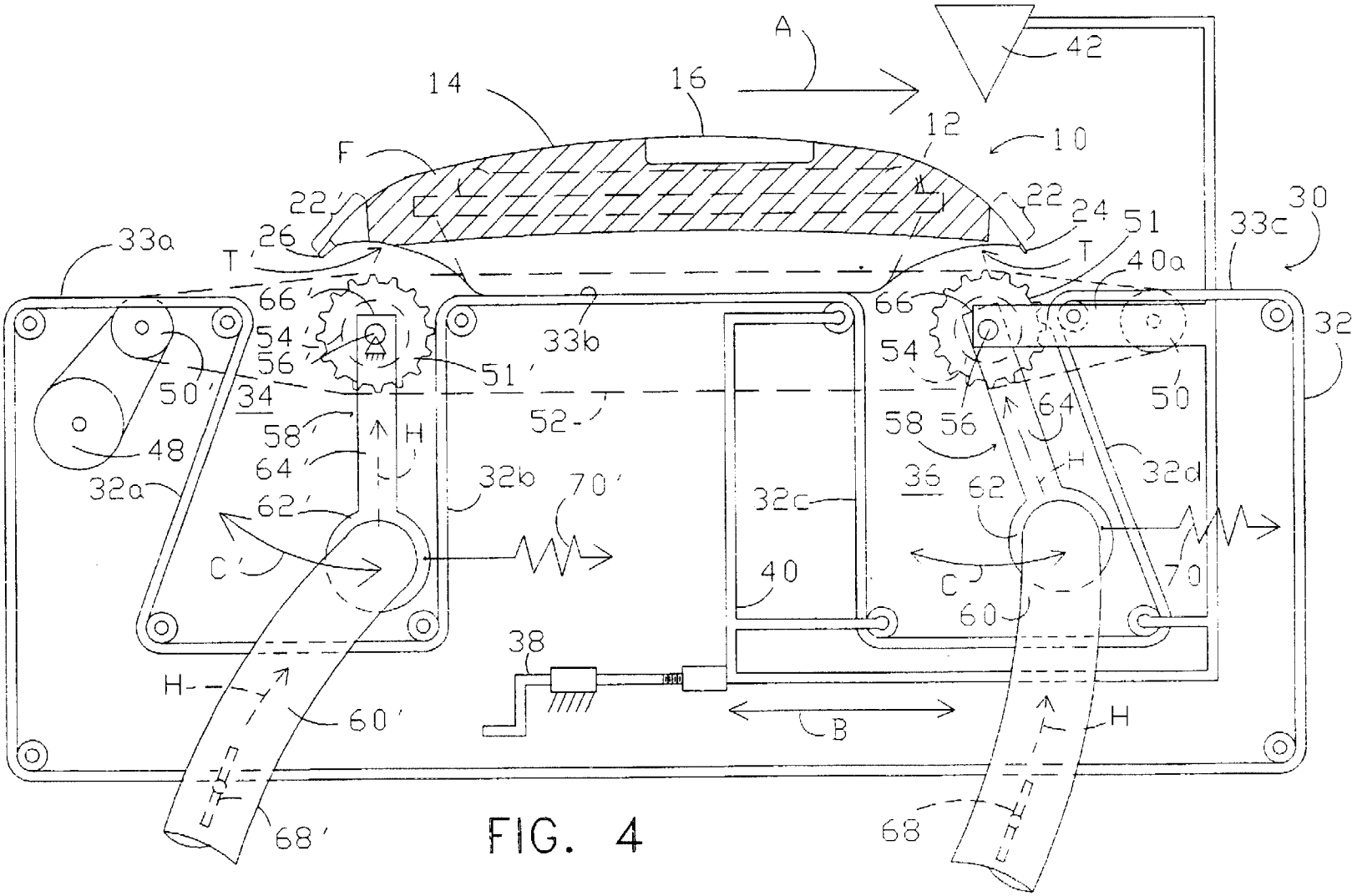
FIG. 4 is a side elevation schematic view of an apparatus for shrinking selected portions of film according to the present invention with a film-wrapped tray in position for such shrinking.

In order to form consistently acceptable packages 10 such as that shown in FIG. 2, a selective shrinking apparatus 30 of the present invention, shown in FIG. 4, is employed. As illustrated in FIG. 4, conveyor 32 is formed of any known construction, such as, for example continuous belting or parallel side chains connected with a series of intermediate suspended bars, and configured to convey a package 10 longitudinally in the direction indicated by arrow A. The portions T, T' of film F which reside inboard and beneath the rim of tray 12 are oriented substantially widthwise of conveyor 32. Conveyor 32 is entrained on the illustrated series of rollers to form a series of product conveying surfaces 33*a*, 33*b* and 33*c*, fixed gap 34 residing between gap side portions 32*a* and 32*b*, and positionably adjustable gap 36 residing between gap side portions 32*c* and 32*d*. The open space between product conveying portions 33*a* and 33b and the open space between product conveying portions 33*b* and 33*c* are substantially equal, and each is smaller in length than the length of the bottom surface of any package which is intended to be processed. Whereas, the pitch distance, i.e. the distance from the beginning of fixed gap 34 to the beginning of positionable gap 36, is preferred to be not greater than the length of tray 12, gap 36 may be moved closer to or farther from fixed gap 34 (see arrow B) to accommodate the length of a particular style of tray 12. The result is that leading seam 24 of package 10 passes over positionable gap 36 at substantially the same time as trailing seam 26 passes over fixed gap 34. This positioning thus ensures that leading and trailing seams 24, 26 are subjected to heat at the same time. To permit this gap position adjustment, gap frame 40 mounts the series of rollers illustrated in FIG. 4 which serves to define and position gap 36 longitudinally with respect to conveyor 32. Gap frame 40 is adjustably mounted to move when gap position adjuster 38, for example a crank, is activated in either direction as indicated by arrow B. Nozzle 58 and components connected thereto are mounted on frame 40 so as to be positioned in coordination therewith.

Figure 5:
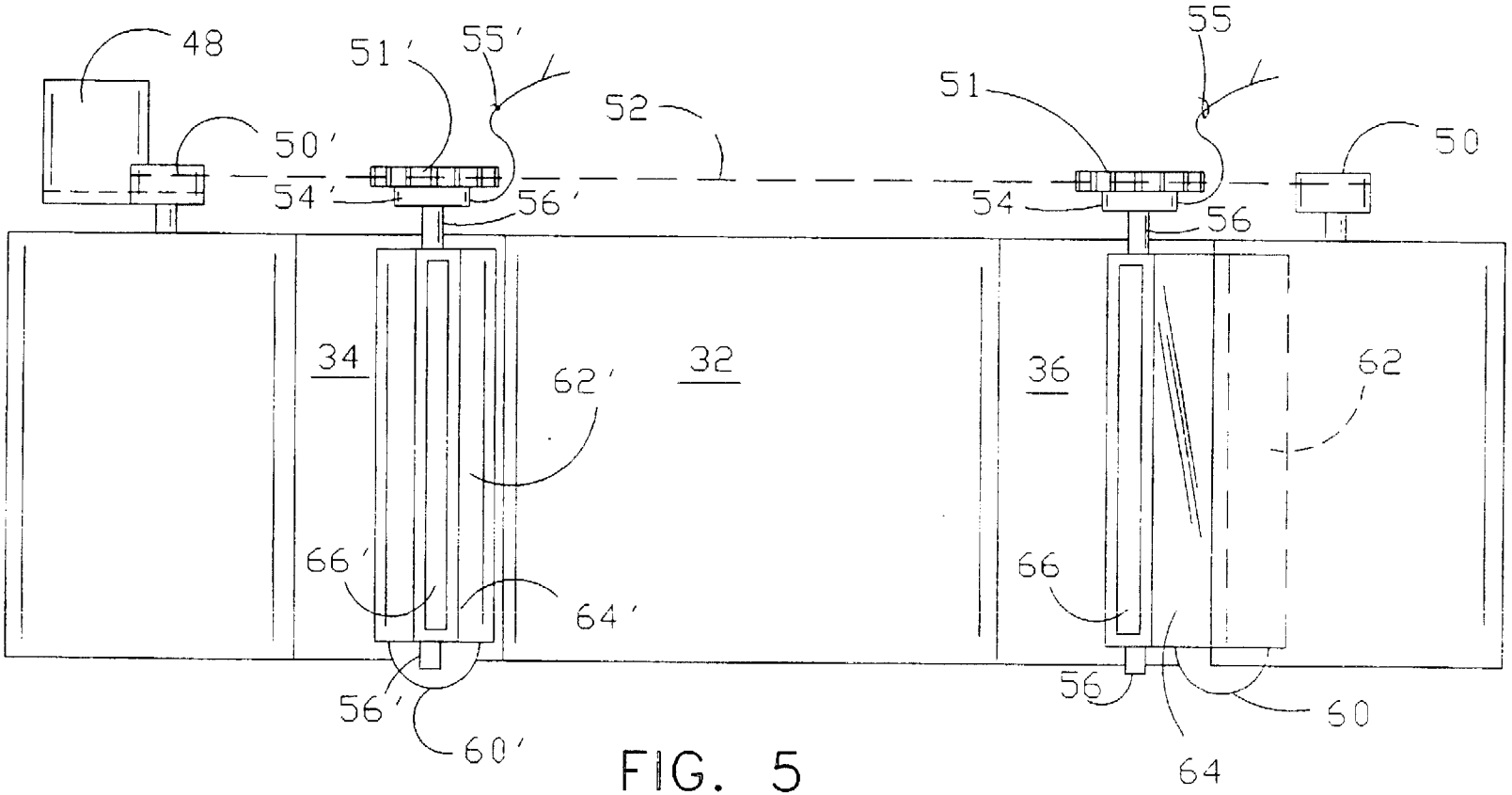
FIG. 5 is a top plan view of the apparatus of FIG. 4, illustrated without the film-wrapped tray for clarity.

Since the apparatus of the invention has similar components located in each of gaps 34 and 36, the description which is next directed to positionable gap 36 applies equally to corresponding fixed gap 34. Side elevation view FIG. 4 and top plan view FIG. 5 (illustrated without package 10) are both pertinent to this description.

Figure 7:
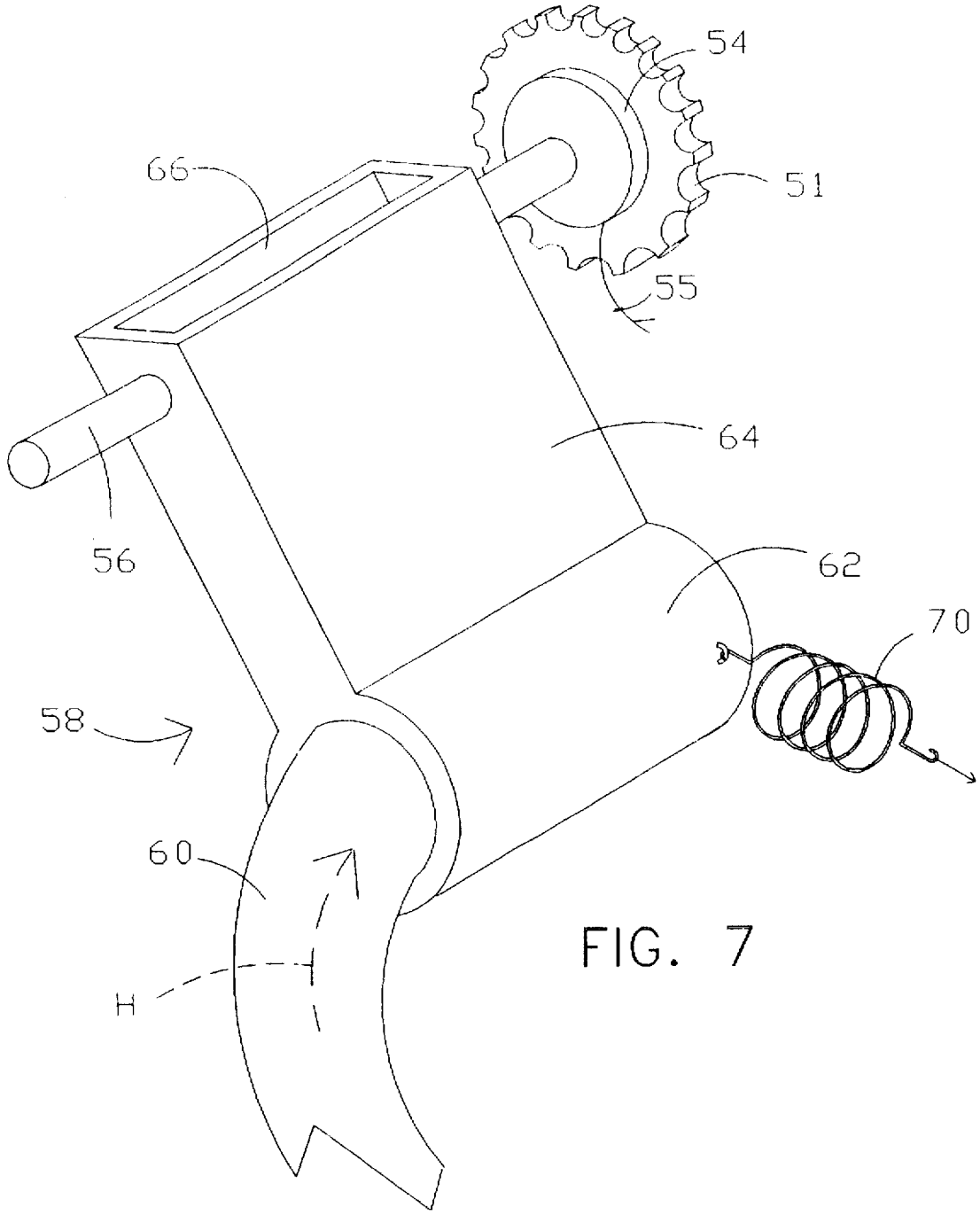
FIG. 7 is a perspective view of a pivotable nozzle of the present invention for directing hot air at an end portion of a moving film-wrapped package being conveyed.

A positionally controllable heat outlet, for example, nozzle 58 is pivotably mounted to be able to deliver heat over a selected partial bottom surface area of film F. Pivotably mounted nozzle 58, which is illustrated in perspective detail in FIG. 7, is made up of chamber 62, duct 64 and outlet portion 66. Nozzle 58, flexible hose 60 and valve 68, see FIG. 4, in combination comprise a heat source for shrinking portions of film F. Nozzle 58 is mounted on shaft 56 so as to pivot about shaft 56 onto which magnetic clutch 54 and sprocket 51 are secured. The width of outlet portion 66, measured in a direction widthwise of conveyor 32, is preferably equal to the width of conveyor 32. Shaft 56 is positioned such that outlet portion 66 of nozzle 58 resides proximate and below the plane occupied by product conveying surfaces 33*a*, 33*b* and 33*c*. Magnetic clutch 54, when engaged, drives sprocket 51 and shaft 56. Sprocket 51 is driven through a sprocket chain 52 by motor pulley 48 and drive sprocket 50'. In operation, motor pulley 48 rotates drive sprocket 50' which drives chain 52 and sprocket 51 which is engaged with magnetic clutch 54. Clutch 54 is activated by an electric signal through wires 55 (FIG. 5), caused by a signal generated by sensor 42 upon detecting the arrival of package 10. Sensor 42 is a device capable of detecting and responding to the movement of an object at a given point, such as, for example, a photocell or microswitch. Magnetic clutch 54 engages to cause nozzle 58 to pivot in the clockwise direction along arrow C in opposition to the biasing force of extension spring 70, or other biasing means. The speed of rotation of magnetic clutch 54 is established to enable nozzle 58 to pivot in the same direction and at an angular speed which matches the speed at which package 10 is conveyed by conveyor 32 so as to track, or move synchronously with, package 10. When nozzle 58 pivots through a selected angle, and chamber 62 approaches vertical side 32*c* of gap 36, a sensor switch (not shown) deactivates magnetic clutch 54, and spring 70 causes nozzle 58 to quickly return counterclockwise to its initial position. In the preferred embodiment disclosed, the shape of fixed gap 34 and the shape of adjustable gap 36 are approximately mirror images of each other so as to provide an optimum field of impingement of hot air against the target portion T of film F as nozzle 58 tracks the movement of package 10 (see FIG. 4).

A supply of hot air (not shown) is provided to the apparatus of the invention through flexible hose 60 which connects to chamber 62. The flexibility of hose 60 permits nozzle 58 to pivot with minimal restriction. Simultaneous with the activation and deactivation of magnetic clutch 54, an air flow control device, such as electrically operated butterfly valve 68 (electric operator not shown), is opened and closed, respectively. Thus, when magnetic clutch 54 engages and begins to move pivotable nozzle 58, valve 68 opens and hot air H flows through flexible hose 60 and nozzle 58 to cause film F to shrink in target portion T. Nozzle 58 is pivoted so as to track package 10 as it is conveyed by conveyor 32. When magnetic clutch 54 disengages, valve 68 is closed by electrical or mechanical means, and spring 70 returns nozzle 58 to its starting point. It is to be emphasized that during this portion of the shrinking process, no other segment of film F is exposed to heated air other than that comprising target portion T which is beneath and inboard of leading seam 24 and trailing seam 26 respectively. In addition, a feature of the method of the present invention is that improved package appearance is maximized by shrinking film F below both leading seam 24 and trailing seam 26 simultaneously.

When package 10 has passed the position in which nozzles 58 and 58' impinge hot air on film F in target portions T and T', no additional hot air is directed to the bottom or to any other portions of package 10. In this manner, both target portions T, T' are shrunk simultaneously, and subsequent heating of additional portions of film F serve to tighten film F and remove wrinkles. Package 10 is next conveyed beyond shrink apparatus 30 of the invention to enter a shrink tunnel providing ambient hot air. A further package is next positioned on shrink apparatus 30 for shrinkage of selected portions thereof.

Figure 6:
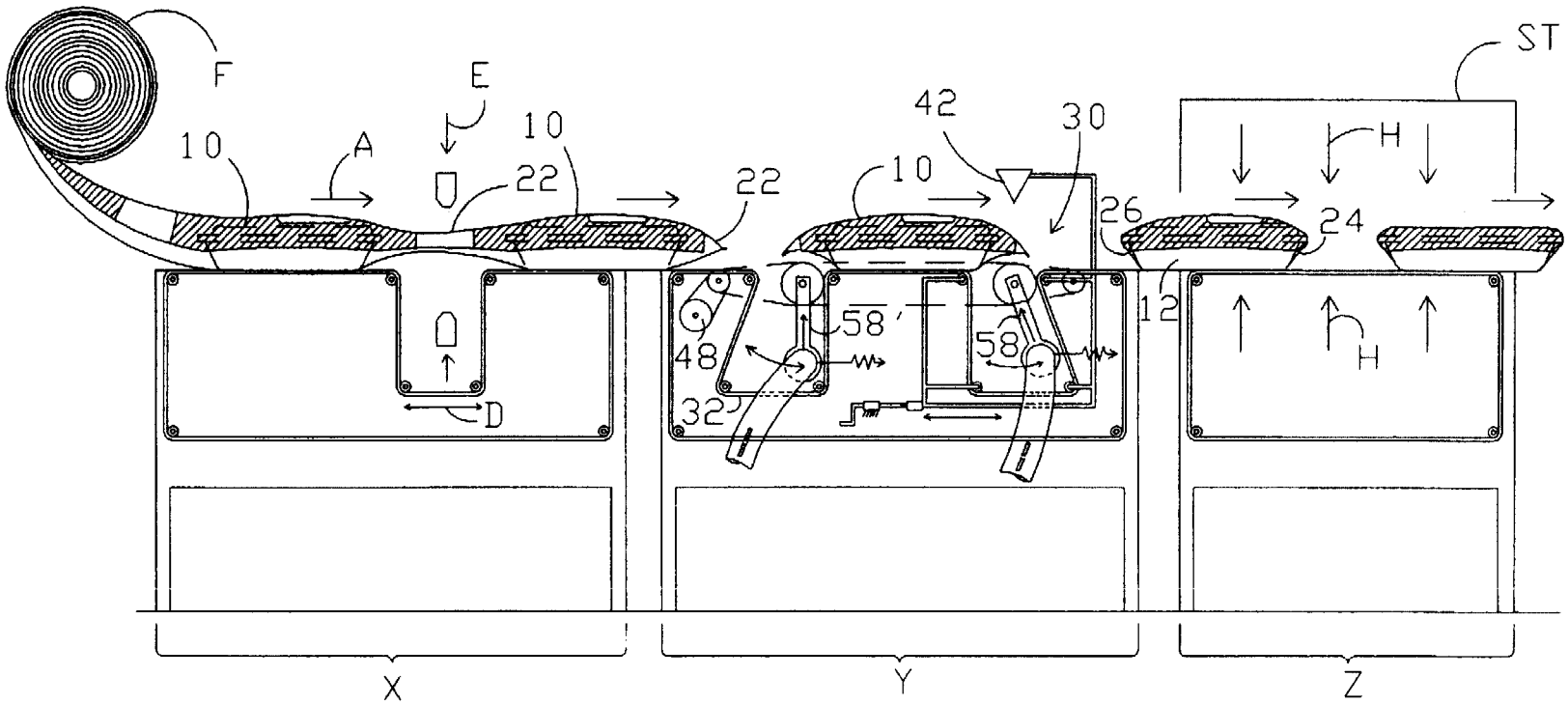
FIG. 6 is a schematic side elevation view of a film wrapping and shrinking production line with details omitted for clarity of illustration for the wrapping in a first machine segment X, and shrinking in both second machine segment Y and third machine segment Z, of film wrapped around a packed tray.

In the context of a total wrapping and shrinking process, a series of equipment units comprising a production line is illustrated in FIG. 6 as represented by station X, station Y and station Z. Station X schematically represents a film wrapping machine in which film F is formed tubularly while moving in the direction of arrow A to wrap each of a series of products, e.g. trays filled with poultry parts, as packages 10. A sealing device E reciprocates along the direction shown by arrow D while sealing film F at clear, unprinted border portion 22 between successive packages 10. Sealing device E also serves to part film F and separate each package from the following one. Each package 10 is next conveyed to station Y comprising the selective shrink apparatus 30 of the invention. After passing over and being impinged by hot air from the pivotable nozzles 58' and 58 of shrink apparatus 30, package 10, with leading and trailing seams 24, 26 tucked beneath the rim of tray 12 (as seen in FIG. 6), passes into a shrink tunnel ST in station Z where hot air is circulated so as to surround film F without discrimination as to the film portion to be shrunk. At the completion of the shrink process as described, package 10 is conveyed to subsequent processing, such as weighing, labelling and boxing.

In summary, the invention comprises an apparatus and method in which heat is directed to selected portions of a heat-shrinkable film while the film, wrapped around a product, is being conveyed. The directing of the heat is coordinated to match the conveying of the film-wrapped package.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An apparatus for shrinking a selected bottom portion of a heat shrinkable film wrapped around a package, comprising:

(a) a longitudinally extending driven conveyor for conveying said package in a selected direction at a selected speed with said selected bottom portion of film oriented substantially widthwise of said conveyor;

(b) a heat source pivotally mounted proximately below and extending widthwise of said conveyor and emitting a flow of heat upwardly toward said package wherein said flow of heat is caused to track said widthwise oriented selected bottom portion of film in coordination with the movement of said package by said conveyor so as to heat and selectively shrink said widthwise oriented selected bottom portion of film while other portions of said film remain unheated; and (c) means to pivot said heat source from a starting position to move in a first direction in coordination with the movement of said package being conveyed by said conveyor and in a second direction which is opposed to said first direction so as to return to said starting position.

2. The apparatus for shrinking a selected bottom portion of a heat shrinkable film wrapped around a package as claimed in claim 1, wherein said heat source is supplied by a valve controlled source of hot air.

3. The apparatus for shrinking a selected bottom portion of a heat shrinkable film wrapped around a package as claimed in claim 2, wherein said valve controlled source of hot air is operable in synchronization with the conveying of said package.

4. The apparatus for shrinking a selected bottom portion of a heat shrinkable film wrapped around a package as claimed in claim 2, wherein said heat source comprises a plurality of hot air nozzles, at least some of which are longitudinally adjustable in position relative to others.

5. The apparatus for shrinking a selected bottom portion of a heat shrinkable film wrapped around a package as claimed in claim 2, further comprising a sensor mounted adjacent said conveyor and adapted for sensing the movement of said package and transmitting a signal to said valve controlled source of hot air and said means to pivot said heat source.

6. A method for shrinking selected first and second bottom portions of a heat shrinkable film wrapped around a package, comprising the steps of:

(a) conveying said package wrapped in said heat shrinkable film in a selected direction at a selected speed on a conveyor with said selected bottom portions oriented substantially transverse to said selected direction;

(b) directing heat from first and second pivotable nozzles each mounted proximately below and extending widthwise of said conveyor so as to emit a flow of heat upwardly toward said package and to cause said flow of heat to track said transversely oriented selected bottom portions of film in coordination with the movement of said package being conveyed on said conveyor in said selected direction at said selected speed while other portions of said film remain unheated;

(c) pivoting each of said first and second nozzles in said selected direction substantially at said selected speed so as to maintain said flow of heat directed at said selected first and second bottom portions of film as said package continues to be conveyed on said conveyor in said selected direction at said selected speed; and (d) discontinuing said heat as said package continues to be conveyed in said selected direction at said selected speed.

7. The method for shrinking selected portions of a heat shrinkable film wrapped around a package as claimed in claim 6, wherein said conveyor comprises a series of product conveying surfaces interspersed with a fixed first gap and a positionally adjustable second gap and said method further comprises the step of positioning said second gap with respect to said first gap such that said first nozzle is positioned in conjunction with said first gap to impinge hot air at said first selected bottom portion of said film substantially simultaneously with said second nozzle positioned in conjunction with said second gap impinging hot air at said second selected bottom portion of said film.

8. The method for shrinking selected portions of a heat shrinkable film wrapped around a package as claimed in claim 6, further comprising the step of sensing said package at a selected position and transmitting a signal to apparatus for activating and redirecting said heat source.

9. An apparatus for shrinking selected bottom portions of a heat shrinkable film wrapped around a package, comprising:

(a) a conveyor driven for conveying said package in a selected direction at a selected speed wherein said selected bottom portions are oriented widthwise of said conveyor;

(b) a pair of heat sources each being pivotally mounted with an outlet portion proximate and below and extending widthwise of said conveyor and moveable in said selected direction at said selected speed so as to be moved in coordination with the movement of said package to impinge hot air at said selected bottom portions of said film as said package is conveyed by said conveyor;

(c) means to synchronize said impingement of hot air from each said outlet portion in conjunction with conveying said package so as to extend the time during which shrinking occurs; and (d) said conveyor being formed with a first gap sized to enclose a first said outlet portion and a second gap sized to enclose a said second outlet portion.

10. The apparatus for shrinking selected bottom portions of a heat shrinkable film wrapped around a package as claimed in claim 9, further comprising means for positionally adjusting said second gap in relation to said first gap.

* * * * *